US007677716B2

(12) United States Patent
Vega et al.

(10) Patent No.: US 7,677,716 B2
(45) Date of Patent: Mar. 16, 2010

(54) LATENT INKJET PRINTING, TO AVOID DRYING AND LIQUID-LOADING PROBLEMS, AND PROVIDE SHARPER IMAGING

(75) Inventors: Ramon Vega, Sabadell (ES); Jordi Ferran, Cerdanyola del Vall (ES); Eduardo Martin, Sant Cugat del Valles (ES); Emilio Angulo, Barcelona (ES); Jorge Castano, Sant Cugat del Valles (ES); Pedro Luis Las Heras, Sant Quirze del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1013 days.

(21) Appl. No.: 11/043,772

(22) Filed: Jan. 26, 2005

(65) Prior Publication Data

US 2006/0164489 A1 Jul. 27, 2006

(51) Int. Cl.
*B41J 2/01* (2006.01)
*B41J 2/15* (2006.01)

(52) U.S. Cl. ..... 347/103; 347/21; 347/101

(58) Field of Classification Search ..... 347/103, 347/101, 21, 2, 3, 4
See application file for complete search history.

(56) References Cited

U.S. PATENT DOCUMENTS

| | | | | |
|---|---|---|---|---|
| 3,060,429 A | | 10/1962 | Winston | |
| 4,357,613 A | | 11/1982 | Wiley et al. | |
| 4,379,301 A | | 4/1983 | Fischbeck | |
| 4,386,358 A | | 5/1983 | Fischbeck | |
| 4,442,439 A | | 4/1984 | Mizuno | |
| 4,697,196 A | | 9/1987 | Inaba et al. | |
| 4,827,295 A | | 5/1989 | Dean, II et al. | |
| 5,124,729 A | | 6/1992 | Nakazawa et al. | |
| 5,298,926 A | | 3/1994 | Fukushima et al. | |
| 5,353,105 A | | 10/1994 | Gundlach et al. | |
| 5,365,261 A | * | 11/1994 | Ozawa et al. | 347/103 |
| 5,369,424 A | | 11/1994 | Hori et al. | |
| 5,444,468 A | * | 8/1995 | Fukushima et al. | 347/14 |
| 5,531,436 A | | 7/1996 | Ohyama et al. | |
| 5,598,195 A | | 1/1997 | Okamoto et al. | |
| 5,754,194 A | | 5/1998 | Endo et al. | |

(Continued)

FOREIGN PATENT DOCUMENTS

EP 0 473 178 B1 5/1997

(Continued)

*Primary Examiner*—Stephen D Meier
*Assistant Examiner*—Leonard S Liang

(57) ABSTRACT

Ejected liquid forms a latent image on a charged transfer surface. In some invention aspects electrostatic charge is first applied to the surface; inkjet devices eject the image-forming liquid; voltage is established between the devices and surface; another, separate substance associated with the latent image actuates it. In other aspects hydrophobic or hydrophilic material in the surface stabilizes the image on it; electrostatic apparatus, associated with the surface, cooperates with the stabilizing material, further controlling image-droplet position and size. In other aspects a desired image forms on a final printing medium, based on an input electronic image-data array; the liquid ejection is onto an intermediate transfer surface, based on detailed incremental control by the data, forming a latent image representing the desired image. An actuating substance, initially discrete from the liquid, is associated with the image, and a reaction initiated to modify that substance—which is transferred from surface to final medium.

27 Claims, 2 Drawing Sheets

U.S. PATENT DOCUMENTS 5,754,199 A 5/1998 Miki et al.
5,781,218 A 7/1998 Wakahara et al.
5,790,151 A 8/1998 Mills
5,794,927 A 8/1998 Uchida
5,821,968 A 10/1998 Ohyama et al.
5,838,349 A 11/1998 Choi et al.
5,854,648 A 12/1998 Hanabusa
5,896,148 A 4/1999 Fukushima et al.
6,019,466 A 2/2000 Hermanson
6,079,814 A 6/2000 Lean et al.
6,097,408 A 8/2000 Fukushima et al.
6,126,274 A * 10/2000 Kohyama ..... 347/55
6,139,140 A 10/2000 Rasmussen et al.
6,170,935 B1 * 1/2001 Wakahara et al. ..... 347/55
6,247,809 B1 6/2001 Kashiwagi et al.
6,309,064 B1 10/2001 Tanno et al.
6,312,110 B1 11/2001 Darty
6,332,612 B1 12/2001 Kanemura
6,354,701 B2 3/2002 Korem
6,386,683 B1 * 5/2002 Muroi et al. ..... 347/55
6,419,411 B1 7/2002 Tanno
6,428,148 B1 8/2002 Gore
6,443,571 B1 9/2002 Shinkoda et al.
6,460,973 B1 * 10/2002 Takahashi et al. ..... 347/55
6,480,299 B1 11/2002 Drakopoulos et al.
6,493,009 B1 * 12/2002 Mukai et al. ..... 346/140.1
6,505,023 B2 * 1/2003 Miyamoto ..... 399/237
6,508,540 B1 1/2003 Lean et al.
6,511,172 B2 1/2003 Tanno et al.
6,514,650 B1 * 2/2003 Schlueter et al. ..... 430/56
6,585,364 B2 * 7/2003 Kasperchik et al. ..... 347/98
6,585,367 B2 * 7/2003 Gore ..... 347/102
RE39,161 E 7/2006 Edge et al.
7,182,454 B2 * 2/2007 Nakazawa ..... 347/102
2001/0022607 A1 * 9/2001 Takahashi et al. ..... 347/103
2005/0110855 A1 * 5/2005 Taniuchi et al. ..... 347/103
2005/0110856 A1 * 5/2005 Mouri et al. ..... 347/103
2005/0248786 A1 11/2005 Tobie et al.

FOREIGN PATENT DOCUMENTS

EP 1 146 726 A1 10/2001

* cited by examiner

LATENT INKJET PRINTING, TO AVOID DRYING AND LIQUID-LOADING PROBLEMS, AND PROVIDE SHARPER IMAGING

RELATED PATENT DOCUMENTS

Closely related documents, incorporated by reference in their entirety into the present document, are U.S. Pat. No. 5,353,105 of Gundlach (Xerox Corporation), and a technical paper of Parks et al., "Thermal Ink Jet Printing in an Indirect Marking System", *Xerox Disclosure Journal* 16 No. 6, at 349-50 (1991)—as well as U.S. Pat. No. 6,354,701 of Korem, and U.S. Pat. No. 6,443,571 of Shinkoda.

FIELD OF THE INVENTION

This invention relates generally to machines and procedures for printing text or graphics on printing media such as paper, transparency stock, or other glossy media; and more particularly to such systems and methods that print incrementally (or "digitally")—i.e., by generating one image at a time, and each small portion of the image at a time, under direct computer control of multiple small printing elements. Incremental printing thus departs from more-traditional lithographic or letterpress printing, which creates an entire image with each rotation or impression of a press.

BACKGROUND OF THE INVENTION

Commercially popular and successful incremental printing systems primarily encompass inkjet and dry electrographic—i.e. xerographic—machines. (As will be seen, the latter units are only partially incremental.) Inkjet systems in turn focus mainly upon on-demand thermal technology, as well as piezo-driven and variant hot-wax systems.

On-demand thermal inkjet, and other inkjet, techniques have enjoyed a major price advantage over the dry systems—and also a very significant advantage in electrical power consumption (largely due to the energy required to fuse the dry so-called "toner" powder into the printing medium). These advantages obtain primarily in the market for low-volume printing, and for printing of relatively short documents, and for documents that include color images or graphics.

a. Liquid loading, and drying time—On the other hand, in thermal-inkjet technology from the outset it has been necessary to deal with certain intrinsic limitations of the process. First, saturated and satisfyingly rich colors with aqueous inks—particularly to substantially fill the white space between addressable pixel locations—require deposition of large amounts of liquid on the print medium.

This heavy liquid loading must be removed by evaporation (and, for some printing media, absorption) before the printed material can be considered finished. Drying time presents a significant annoyance to users.

Hastening of the drying, however, introduces and aggravates other difficulties such as cockle and other printing-medium deformations, as well as offset and blocking. One popular but only partial solution to these adverse phenomena is the highly elaborated art of printmasking, which divides up all the image inking into two or more deposition intervals or so-called "passes".

As is well known, however, such tactics greatly prolong the time required to print an image, thereby offsetting much of the benefit of drying-time improvements. The result is to exacerbate the intrinsically lower speed of inkjet systems relative to the xerographic ones—which actually are incremental in only the latent-image formation stage, and substantially holistic at the point of image transfer to the printing medium.

Other techniques for acceleration of drying include heating the inked medium to accelerate evaporation of the water base or carrier. Heating, however, has limitations of its own; and in turn creates other difficulties due to heat-induced deformation of the printing medium.

Glossy stock warps severely in response to heat, and transparencies too can tolerate somewhat less heating than ordinary paper. Accordingly, heating has provided only limited improvement of drying characteristics for these plastic media.

As to paper, the application of heat and ink causes dimensional changes that affect the quality of the image or graphic. Specifically, for certain applications it has been found preferable to precondition the paper by application of heat before contact of the ink; if preheating is not provided, so-called "end-of-page handoff" quality defects occur—such defects take the form of a straight image-discontinuity band formed across the bottom of each page when the page bottom is released.

Preheating, however, causes loss of moisture content and resultant shrinking of the paper fibers. To maintain the paper dimensions under these circumstances the paper is held in tension, and this in turn leads to still other dimensional complications and problems.

Yet all in all the most severe of the backward steps that accompany the benefits of printmodes is the penalty in throughput. This expression of overall printing speed is one of the critical competitive vectors for inkjet printers.

b. Resolution and stability—A second handicap suffered by inkjet systems, particularly in comparison with dry-process machines, is relatively coarser resolution. Although native inkjet resolutions on the order of 48 pixels/mm (1200 dots/inch) are now the state of the art, especially in high-end printer/plotter machines, as a practical matter much of this capability in color reproductions is sacrificed in the rendition process—so that a more-directly comparable figure may be only about 12 pixels/nm, roughly half that of some comparable dry-process printers.

Furthermore use of very fine droplets to fill a pixel grid is sometimes used as a mechanism for mitigating long drying times. Hence the two characteristics—resolution and drying time—are often inherently linked.

In other words, there may not be as many degrees of freedom as may superficially appear. Coarser effective resolution thus takes on a greater significance when considered together with the previously mentioned drying and liquid-loading limitations: these observations suggest a kind of negative synergism between the two.

Another linkage is even more clear—high liquid loading leads directly to so-called "bleed" between adjacent fields of different ink colors, and in the extreme into even the fibers of adjacent unprinted (uninked) printing medium. This is of course particularly noticeable at color boundaries that should be sharp.

The phenomenon of bleed, here introduced as a matter of degraded resolution, can also (or alternatively) be seen as a matter of instability in the deposited image. That is, the image elements placed on the printing medium are failing to remain where placed. This is another fundamental limitation of the inkjet process as conventionally practiced.

c. Gundlach and Parks—In the previously mentioned Gundlach patent document it is suggested that Gundlach's own hot-transfer invention either can print from latent images made just with ions, or can apply the Parks thermal-inkjet method to form an initial image on a conductive drum that has a thin dielectric skin—and print from that initial image. In neither case, however, does Gundlach (or Parks) suggest any strategy for exploiting these ideas to attack the above-discussed drying-time or liquid-loading problems of inkjet printing as such.

d. Korem and Shinkoda—These patents, also mentioned above, relate to stabilization of ink droplets (or color "dots") on an intermediary surface—for later transfer to paper or other sheet-type printing medium. Stabilization can be promoted by using an intermediary transfer surface that is manufactured with a very small region of material, at each pixel location, that attracts the ink or other colorant substance.

These pixel cells are surrounded by material that repels the same substance, thus creating a dual chemical-affinity differential force for discriminating between desired and undesired colorant positions. As to electrostatic methods, however, Korem and Shinkoda suggest these only for (1) forming or help to form an initial image, as for example a toner image for dry, xerographic systems; or (2) transferring or helping to transfer the colorant from the intermediary surface to the final sheet-type printing medium.

e. Conclusion—Market interest in desktop printers, digital copiers and other types of reproduction equipment continues to increase. The demand for faster and more efficient printing methods has forced designers to push the current implementations to their limits. A fundamental reconfiguration may be required a this point.

In summary, achievement of uniformly excellent inkjet printing continues to be impeded by the above-mentioned problems of drying time and liquid loading—particularly in the mutually exacerbating interaction of these factors with inherently somewhat coarse resolution, or image instability. Thus extremely important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits.

In preferred embodiments of a first of its facets or aspects, the invention is a printing device. The device includes some means for applying an electrostatic charge to a transfer surface. For purposes of generality and breadth in discussing the invention, in the present document these means may be called simply the "applying means".

The device also includes some means for ejecting a liquid to form a latent image on the charged transfer surface. Again for generality and breadth these means may be called simply the "ejecting means".

The ejecting means are preferably inkjet printing means; in other words, they preferably include at least one inkjet printhead—or, alternatively, one dye-sublimation apparatus. The ejecting means are, at least very generally, conventional; and are operated under computer control to fire or apply the liquid in a controlled image pattern, as is usual for e.g. inkjet printing systems.

For purposes of this document the word "image" need not refer to a pictorial image (such as a photograph of a scene, or a drawing etc.), but rather is to be interpreted broadly. Thus the image may be any pattern, whether visible (or intended to be made visible) or not, and regardless of the nature of its intended use. Merely by way of example, the "image" may be a pattern having no particular representational meaning or esthetic significance but instead having industrial uses, etc.

The device of this first facet of the invention further includes some means for establishing a voltage between the transfer surface and inkjet printing means. Yet again for breadth and generality these means may be called simply the "establishing means".

The device also includes some means for associating another, separate substance with the latent image on the transfer surface for actuating the image. For purposes of this document, the word "actuating" is a broad term. For images that are visible or are to be made visible, the term "actuating" refers to making the image visible, or enhancing its visibility; whereas, in the case of industrial and like uses, the term refers to making the image functional, or enhancing its function. Again, for like reasons as before, these means will be called the "associating means".

The foregoing may represent a description or definition of the first aspect or facet of the invention in its broadest or most general form. Even as couched in these broad terms, however, it can be seen that this facet of the invention importantly advances the art.

In particular, because the actuating substance is separate from the liquid used to create the latent image, the former need not satisfy requirements for inkjet ejection. For example, this actuating substance need not be amenable to projection by inkjet equipment. Among other critical factors, the actuating substance need not be (though it can be) liquid, or flowable.

Conversely, the inkjet-defined liquid used to establish the latent image need not satisfy any requirements or desirable characteristics for actuating the image (or, as will be shortly seen, transferring it to a final image sheet if desired). In particular it need not have any particularly sensitive properties with respect to drying on paper or on other sheet-type printing medium.

In short the materials and procedures used in the two stages (latent-image formation and development, respectively) can be optimized independently. Thus this first principal facet of the invention, either completely eliminates or very greatly mitigates all the previously described daunting problems of the prior art.

Although the first major aspect of the invention thus very significantly advances the art, nevertheless to optimize enjoyment of its benefits preferably the invention is practiced in conjunction with certain additional features or characteristics. In particular, preferably the transfer surface is generally rigid.

If this basic preference is observed, then three other, nested subpreferences also come into play: first, the printing means are spaced from the transfer surface more closely than feasible for inkjet printing on paper or other deformable sheet-type printing medium. If so, then the printing means are spaced from the transfer surface by two millimeters or less; and most ideally the distance is roughly one millimeter.

There are other basic preferences. Preferably (but of course not necessarily) the transfer surface is cylindrical; alternatives include an endless belt or the like.

If the device of the invention is for use with paper or other deformable sheet-type final image surface, then the device further includes some means for transferring the separate substance to the final image surface. As before, once again for breadth and generality, these means will be called the "transferring means". Preferably the transferring means bring the transfer surface into contact with the final image surface.

Nested subpreferences of this basic preference include these: preferably the transferring means also operate by electrostatic attraction between the separate substance and the final image surface. If so, preferably the device further includes some electrostatic means for stabilizing the latent image on the transfer surface; and if present then these stabilizing means include a grid in the transfer surface, for stabilizing the latent image by a combination of electrostatic force and hydrophilic or hydrophobic affinity.

If electrostatic attraction is used as part of the transferring means, then the device further includes some hydrophilic or hydrophobic means for stabilizing the latent image on the transfer surface. If so, then these means preferably include a hydrophilic or hydrophobic grid in the transfer surface.

Yet another basic preference is that the other, separate substance be a material that cannot be ejected from the inkjet printing means. Still another basic preference is that the other, separate substance be a solid or liquid ink, or a toner.

Yet another such preference is that the other, separate substance include plural such substances of different colors, for cooperating to form a color image. A further basic preference is that the device further include some electrostatic means for stabilizing the latent image on the transfer surface.

In preferred embodiments of its second major independent facet or aspect, the invention is an image-printing device. The device includes inkjet printing means for ejecting a liquid to form a latent image on a transfer surface; as before, for purposes of generality and breadth these means will be called the "ejecting means".

The device also includes hydrophobic or hydrophilic means in the transfer surface for stabilizing the latent image on the surface. For the same reasons as before, these will be called the "stabilizing means".

Also included are electrostatic means, associated with the transfer surface and cooperating with the stabilizing means, for further controlling position and size of liquid droplets in the latent image. These are identifiable as the "further controlling means".

The foregoing may represent a description or definition of the second aspect or facet of the invention in its broadest or most general form. Even as couched in these broad terms, however, it can be seen that this facet of the invention importantly advances the art.

In particular, this dual stabilization mechanism, i.e. the combination of affinity-based and electrostatic stabilization used together, helps to overcome the problem, mentioned above, of image droplets that expand—and even migrate—by virtue of the flowable, liquid character of the image medium itself. This second principal facet of the invention tends strongly to keep all the image dots where they belong, and prevent them from spreading.

Although the second major aspect of the invention thus significantly advances the art, nevertheless to optimize enjoyment of its benefits preferably the invention is practiced in conjunction with certain additional features or characteristics. In particular, preferably the stabilizing means include a grid—ideally within the transfer surface—that creates a hydrophobic or hydrophilic latent image; and the electrostatic further-controlling means comprise means for creating an electrostatic latent image, which is superimposed on the hydrophobic or hydrophilic latent image.

Another basic preference is that the device further include some means for associating another, separate substance with the latent image for making the image visible. In this case, if the device is for use with paper or other deformable sheet-type final image surface, then it is further preferable that the device include some means for transferring the separate substance to the final image surface.

In preferred embodiments of its third major independent facet or aspect, the invention is an image-printing method. This method is for forming a desired visible image on a final printing medium—based on an input electronic data array representing the desired image.

The method includes the step of ejecting a liquid onto an intermediate transfer surface, based on detailed incremental control by the data array, to form a latent image representing the desired image. It also includes the step of associating an actuating substance, initially discrete from the liquid, with the latent image. (As before, the term "actuating" refers to creation or enhancement of visibility—or of some other function—of the latent image.)

Yet another step is initiating a reaction to modify the actuating substance. A still-further step is transferring the actuating substance from the transfer surface to the final printing medium.

The foregoing may represent a description or definition of the third aspect or facet of the invention in its broadest or most general form. Even as couched in these broad terms, however, it can be seen that this facet of the invention importantly advances the art.

In particular, the benefits enjoyed here are closely related to those of the first facet of the invention; however, it may be noted that in some ways this third facet is couched more broadly. Thus for example the method need not be tied to inkjet-type operation as such, and any way of producing the liquid latent image on the transfer surface may serve.

Although the third major aspect of the invention thus significantly advances the art, nevertheless to optimize enjoyment of its benefits preferably the invention is practiced in conjunction with certain additional features or characteristics. In particular, one preference is that the actuating substance in fact make the image visible or increase its visibility. An alternative preference is that the actuating substance cause the image to be more effective than initially, for its particular purpose.

That purpose is advantageously selected from one of these:

- preparing a mask or deposition layer for circuitry manufacture;
- applying a coating with designed properties onto a particular medium;
- watermarking;
- obtaining a flexible printed overlay for application onto three-dimensional objects.

Also preferably the method includes the step of stabilizing the latent image on the transfer surface electrostatically. A subsidiary preference is inclusion of the step of facilitating the transferring step electrostatically. As to the initiating step, an added preference is that it include the step of applying heat, or UV or other radiation, or a catalyst, or a combination of one or more of these.

Another basic preference is that the intermediate transfer surface be rigid. In this event, it is additionally preferred that the intermediate transfer surface be cylindrical.

Still another basic preference is that the ejecting step include firing the liquid across a gap of less than two millimeters—from a computer-controlled printhead to the transfer surface. If this preference is observed, then three nested sub-preferences are that the gap be roughly one millimeter—and further that the method include stabilizing the latent image by an electrostatic field across the gap. Yet another is that the field be on the order of 600 V/m or less.

All of the foregoing operational principles and advantages of the present invention will be more fully appreciated upon consideration of the following detailed description, with reference to the appended drawings, of which:

DETAILED DESCRIPTION OF THE PREFERRED EMBODIMENTS

1. Latent Image Creation

Figure 1:
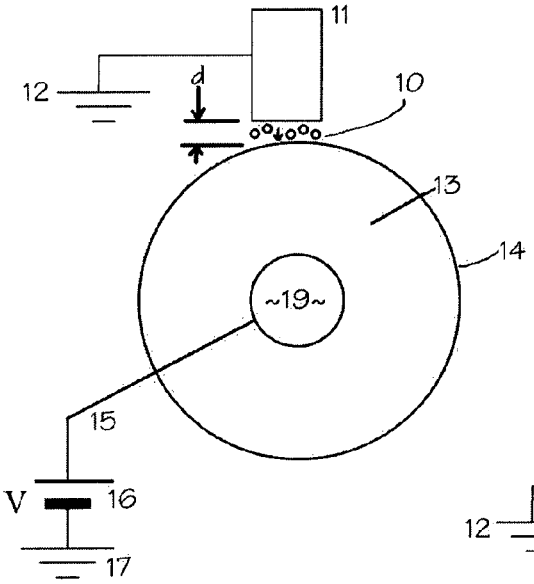
FIG. 1 is an elevation, highly schematic or conceptual, of apparatus according to some preferred embodiments of the invention—including a drum used as intermediate transfer surface and with electrostatic latent-image enhancement, and shown particularly in a latent-image forming mode.

Latent image creation is a process analogous to the exposition process in DEP printers. The present invention is based on ejection of some kind of liquid 10 (FIG. 1) by an inkjet printhead 11, preferably fixed at a voltage 12 (e.g. ground).

Droplets of the liquid are ejected onto an imaging surface of a drum or other object 13 such as a drum—to create a latent image on this imaging surface. Properties of the surface 14 itself will be introduced shortly.

The latent image is closely analogous to any other inkjet image but—at least at this stage—need not be formed in visible inks or pigments. It will later be developed and usually transferred to a sheet-type printing medium.

The head 11 and object 13 are most commonly adapted for mutual relative motion, as for example rotation of the drum about a hub 19; and the drum is preferably fixed 15 at another voltage 16 (most typically 600 V) relative to the printhead voltage 12, 17 (both most typically ground).

The latent imaging can either be created by the difference between wet and nonwet areas as such, or by the difference of electrostatic charges between wet and nonwet areas. Both mechanisms can be combined to improve the posterior adherence of pigment carriers—be they liquid inks, or toner particles, or other substances.

The principle behind electrostatic latent imaging is the discharging of a precharged imaging drum or like object 13 by ejecting onto it water or other liquid droplets 10—charged at opposite polarity by induction. To make this possible, the imaging object consists of a conductive article (e.g. cylinder) 13.

This article is coated by a thin layer (~20 to 50 μm, limited by mechanical robustness) of a dielectric material 14 of high bulk resistance. The bulk resistance of this material is selected so that, on one hand, the latent image is preserved without significant degradation until the development process (deposition of liquid or solid ink, or fixer) is complete.

On the other hand, the bulk resistance of the coating 14 is selected to be conductive enough so it helps discharge the latent image residual charges after development, avoiding a residual charge that could lead to some gray level instead of white in the image background.

The printhead 11 is located at a short distance from the drum 13 to enhance the electrostatic effect, and is grounded 12 to ensure a stable and controlled electric field between it and the drum. This is usually essential to control the latent-image formation process.

In such a structure, the field between the drum and the printhead depends on the voltage 16 applied 15 to the drum, and the distance between drum and printhead. The thickness of the drum coverlayer 14 will not be taken into consideration, as its thickness is much smaller than the gap between drum and printhead.

Therefore, the electric field before ink deposition will be $\underline{E}=\underline{V}/\underline{d}$, where $\underline{V}$ is the voltage between drum and printhead and $\underline{d}$ the distance between them. Under the influence of such an electric field, the charge density in the drum just beneath the dielectric layer can be found using Gauss's Law as—

$$\sigma = \varepsilon_o \varepsilon_r E = \varepsilon_o \varepsilon_r \frac{V}{d}.$$

Voltage on the drum can be taken as around 600 V, and the distance between printhead and drum as just 1 mm. This spacing is significantly closer than in usual inkjet systems, as the receiving medium is the stable drum—instead of paper or other sheet media.

In conventional inkjet environments, the paper or like printing medium tends to deform and can damage the printhead. Hence the printhead-to-paper spacing conventionally must be kept relatively high to maintain the equipment in working order.

In the circumstances of the present invention, however, a one-millimeter spacing is quite amply conservative, and the charge density can accordingly be:

$$\sigma=8.85\cdot10^{-12}\cdot1\cdot600/0.001=5.31\ \mu C/m^2.$$

This is the charge density creating the electric field between the drum and printhead. The field is 0.6 kV/mm, well below the air-ionization value of 3 kV/mm.

Drops fired by the printhead will be charged by induction due to the presence of this electrical field. The net charge in the droplets will oppose the polarity creating the field and will therefore compensate it partially.

For the induction mechanism to be effective the ink must be somewhat conductive; otherwise the lack of charge mobility in the liquid fired by the printhead will not allow its charging. The magnitude of charge developed and transported by the drop depends on the size of the drop—and on the intensification effect derived from the relative sharpness of the shape of the drop tip when it is ejected, i.e., the extent to which the tip of the drop forms a sharp point.

To try to quantify this charge it is helpful to focus on a single nozzle. The charge density associated with the nozzle area is $\Delta\sigma=\underline{Q}_d/\lambda^2$, where $\underline{Q}_d$ is the total charge carried by the drop associated with this area and $\lambda$ is the nozzle side (i.e. transverse dimension)—which is related to the resolution of the printhead.

$\underline{Q}_d$ depends on the number of drops deposited in each of the nozzle cells of the drum, the ink density to be delivered to the drum, and the charge carried by a single drop: $\underline{Q}_d=n_p\underline{a}\underline{q}_d$.

If the analysis is restricted to a single drop per nozzle cell area and 100% density, $$\underline{Q}_d=\underline{q}_d=\underline{c}\pi\underline{R}^2\in_o\in_r\underline{E},$$

where $\underline{c}$ is a form factor accounting for the field intensification around the drop tip derived (as mentioned above) from the degree of pointedness of the drop tip, and $\underline{R}$ is the drop radius. Using a prolate-spheroid approximation to determine $\underline{c}$, a first estimation of the charge enhancement due to the field enhancement in the drop tip is between 3 and 200.

Given that this model is probably exaggerating the enhancement, a value about one order of magnitude smaller than the upper limit just stated may be a relatively conservative value for $\underline{c}$. Therefore a value of $\underline{c}=20$ will be used here.

To find an estimate for the discharging efficiency of the printhead, the charge density conveyed by the drops can be compared with the initial charge present in the drum before the printing (latent image creation) operation. Expressing the former as a fraction of the latter:

$$\frac{\Delta\sigma}{\sigma}=c\pi\frac{R^2}{\lambda^2}\cdot\frac{\varepsilon_0\varepsilon_e E}{\varepsilon_0\varepsilon_e E}=c\pi\left(\frac{R}{\lambda}\right)^2.$$

If the grid is 600 dpi, $\lambda=65$ μm. On the other hand, a typical drop will have a radius around $\underline{R}=15$ μm. Therefore $\Delta\sigma/\sigma=20\cdot3.1415\cdot(15/65)^2=3.35$.

This result is not physically possible, as it implies a polarity change on the drum. What it means is that the charge deposited on the surface of the drum would be of the same order of magnitude as the charge already present there, and the electric field to the printhead would be reduced.

The charge induced in the drop, as well, would be reduced—and the final result would be some residual charge, probably around ten percent of the original value. In practical terms, this means a residual charge around 0.53 $\mu C/m^2$ or a field of 0.06 kV/m, instead of the original 5.3 $\mu C/m^2$ or 0.6 kV/m.

Under somewhat different conditions the initial field could cause ionization of air near the drop and even further enhance the discharging effect. This effect can be controlled by proper adjustment of the printhead-to-drum distance and voltage.

Provision should be made to keep the printhead nozzle plates properly clean—against build-up of aerosol residuals. Such aerosol residuals, sometimes called "puddling", will eventually degrade printing if not cleaned away periodically. The two very differentiated levels of charge and field should allow a proper posterior development with an adequate signal-to-noise ratio.

2. Development

As mentioned above, for actual visualization or other actuation of the initially latent image this system can use solid or liquid ink, or toner, or more generally an overcoating of some other substance. Most particularly this is a substance that is selected for its final-stage imaging properties and that in general is not suited for writing in conventional inkjet technology. Adherence provided by the wetting of the deposited ink complements electrostatic latent image formation.

Once a latent image has been created on the drum as described above, this image can be conceptualized either as a latent wet (i.e. fluid) image or a latent charge image. The latter is similar to the latent charge images used in operation of now-common laser printers—i.e., xerographic printing, also sometimes called "dry electrostatic printing" (DEP).

Similar latent charge images are also used in the so-called "liquid electrophotographic printing" (LEP) methods exemplified by Hewlett-Packard Indigo™ printers with their liquid ElectroInk™. This technology electrically positions print particles that are smaller than dry toner particles—and that are solidified upon transfer to the substrate so that the finished product comes out dry.

Figure 6:
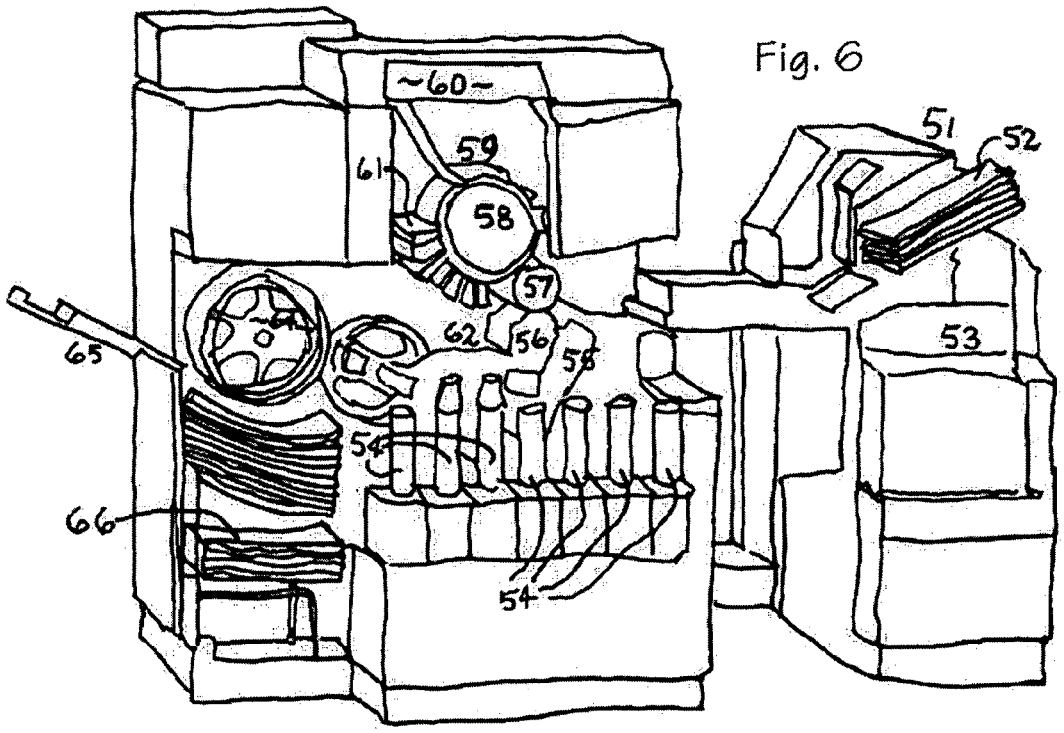
FIG. 6 is a like view of an HP Indigo™ Model 3050 printing press, which is one representative output-stage system for the present invention.

Therefore, this method of creating a latent image on a surface could enable, on one hand, all the different known development processes—including DEP or LEP, or both. Thus the output stages of such a system may closely resemble a representative Indigo printer with its paper feed unit 51 (FIG. 6), secondary paper tray 52, primary paper input tray 53, ink cans 54, duplex conveyor 55, impression drum 56, blanket cylinder 57, and photo imaging cylinder 58. Other components include a scorotron 59, writing head 60, ink rollers 61, perfecter 62, intermediate rotor 63, exit rotor 64, sample tray 65, and output stacker 66. On the other hand this method could open the door to new ways of developing that image, taking advantage of the wettability of the surface.

A few development strategies are described representatively in subsections 5 through 7, below, of this "DETAILED DESCRIPTION" section. Based on the discussions in the present document, people skilled in this field will readily recognize many other approaches to development of the latent image.

3. Advantages Over Direct Transfer and Direct Printing

It is straightforward to see that the latent image itself could be formed on the drum using an ordinary visible ink—so that the image could be transferred directly to the final printing medium as colorant, without electrostatic development. Still more straightforwardly, the printhead could be used to print the image directly onto the printing-medium surface, as in a conventional printer.

In some cases, however, being able to print the image onto an intermediate surface—and particularly as part of an electrostatic transfer process—can be extremely beneficial. An especially advantageous characteristic of the indirect method of the present invention is the earlier-mentioned capability to employ second-component overcoatings selected exclusively for their final-stage imaging properties.

These materials need not be used at the stage of writing—i.e. in latent-image formation. Therefore, even though the initial image definition is established by a nearly conventional ejection of jettable liquid, these overcoatings or second-component materials need not be water based or indeed even liquid based. They can be independently optimized for other criteria, e.g. their drying properties, or vivid color, or in special applications even for mechanical characteristics, or combinations of all these.

Further, as pointed out earlier a suitably designed drum does not significantly expand or wrinkle as does paper or the like. Therefore the printhead can be located much closer to such a drum than to a flexible sheet medium. The result is far finer drop placement, since drop-placement error is a function of (among other influences) distance to the receiving medium, and relative speed.

In addition, with electrostatic latent-image retention the deposited image elements can be better controlled before the system is ready for transfer to a final, sheet-type printing medium. This characteristic enables images initially placed by inkjet to have and retain a crispness more commonly associated with fused-powder printing. In other words, resolution is much improved.

Moreover the image can be created in multiple passes on the drum, but transferred in a single step. This allows use of fewer firing nozzles (less cost) and, again, avoids the deformation of printing media.

As mentioned earlier, multipass direct-print systems may suffer from paper cockle (deformation, usually due to wetting or preheating), which in turn forces the system to work at higher pen-to-paper distance, with poorer drop placement. All these problems are avoided by the present method; yet this method is capable of economical transfer of the image in a liquid (though it may be partly dried) state, or a semiliquid state, preferably without the high-power heating needed to fuse a powder.

Hence the present invention opens the door to elimination or very great mitigation of the liquid-loading, deformation, and throughput problems discussed near the beginning of this document. At the same time these same mechanisms provide an opportunity to achieve great improvements in effective resolution.

All these considerations place important process controls at the disposal of system designers, and thereby of operators too. Multiple image-formation passes can be performed, and the printhead height above the drum can be set directly as a function of acceptable drop-placement error (DPE) and target speed (or throughput).

There is flexibility to use a hybrid solution of multipass or multitransfer, or both. Thus a latent (direct) image can first be created in multiple passes and then transferred.

This latter entire-page transfer process in turn can be performed—if preferred—actually by a sequence of transfers, akin to multipass inkjet printing. For example the first transfer can lay half of the ink on the media, and a second transfer can apply the rest.

The present invention also gives flexibility to design the drying system: either drying the ink on the drum prior to transfer, or drying the ink on the media between transfers (which could improve the quality of the printed output)—or combinations of these approaches to optimize a tradeoff between speed and image quality.

Of special importance, since major advantages of the invention can flow from preserving the low-power benefits of inkjet printing, is the option of transferring the image in the form of a liquid or some other material that needs no fusing, for fixation on the final printing medium. In particular the image may be carried in any one of a great number of physical forms, by previously mentioned overcoating or other materials (e.g., wax-based pigments) that are not at all amenable to being directly fired or jetted by the inkjet process.

The fundamental benefit of this last-mentioned feature, once again, is that image formation and image transfer can be optimized separately and independently. In this way the previously discussed knotty problems of image transfer in conventional inkjet work are almost entirely avoided.

4. Pixel and Drop Stabilization

Figure 3:
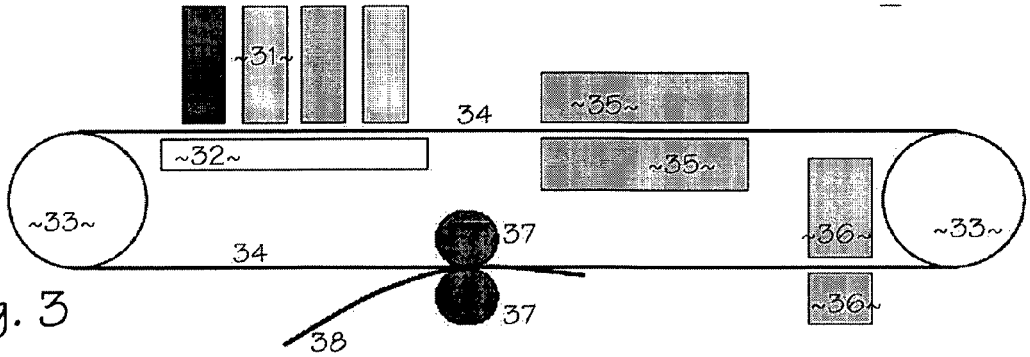
FIG. 3 is a cross-sectional elevation, highly schematic, of an alternative or variant form of the apparatus using an intermediate transfer surface in the form of an endless belt instead of a drum—but also particularly incorporating a liquid-ink system analogous to that of the HP Indigo™ printing presses, instead of electrostatic processing.

The present invention encompasses use of a novel hard-coded grid (e.g. hydrophilic or hydrophobic mesh) embedded in the writing surface 14 of the drum 13—or equivalently of a belt 34 (FIG. 3).

Figure 2:
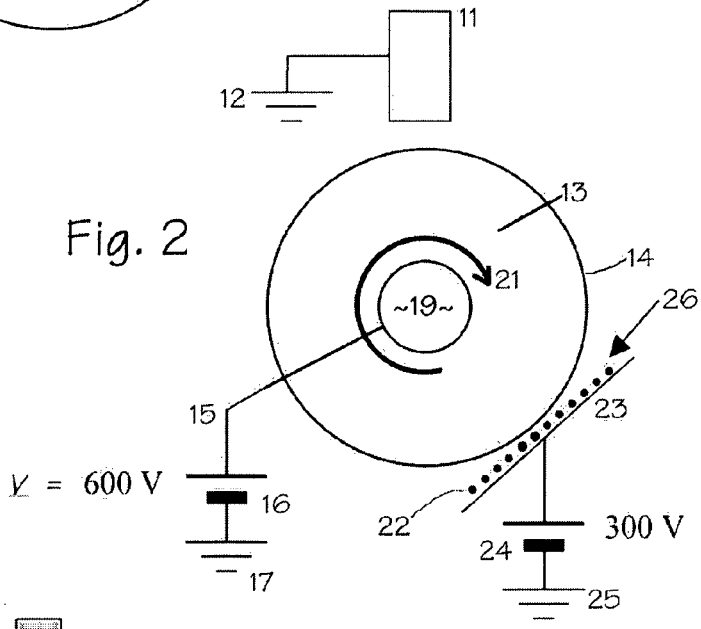
FIG. 2 is a like elevation of the same apparatus but in a generally representative (though not necessarily preferred) later latent-image development mode.

In the latter geometry, preferably two rollers 33 carry the endless belt 34 past an inking (or other colorant-applying) station 31 with vacuum assist 32. This station advantageously also includes electrostatic stabilization of latent-image formation (FIG. 1) and development (FIG. 2).

As pointed out earlier, these two mechanisms in combination represent an advancement over each of the two used singly. This advancement has never been suggested heretofore.

After passing the image-application station 31, with its associated predrying and stabilization module 32, the belt carries the image between two pressure rollers 37, which also squeeze a sheet of printing medium 38 firmly against the image on the belt.

(As noted earlier, the drawing is highly schematic. It will be understood that in practice it may not be desirable to pass the latent image around a roller 33.)

Pinching 37 of the sheet of printing medium 38- and the image on the belt 34—together transfers the image from the belt to the sheet 38. Thereafter residual ink, paper fibers, charge etc. on the belt are removed in a cleaning station 36, and the belt then passes through a dryer 35 in preparation for reuse by application of the next image.

Figure 4:
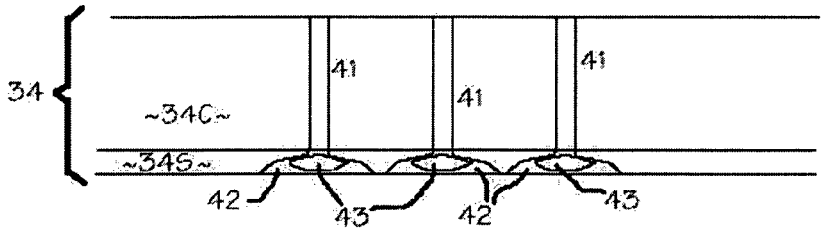
FIG. 4 is a like view but very greatly enlarged and still more schematic, showing the internal structure of a pixel/dot stabilization grid that is preferably formed of hydrophilic and hydrophobic substances, embedded in the FIG. 3 belt in accordance with some preferred embodiments of the invention—shown particularly with the belt not subjected to compression, and with the illustrated belt segment positioned at the bottom of the loop approaching (or after passing through) a pair of pressure rollers.

Key to operation of this system is the specialized internal structure of the belt 34. In particular the belt includes ink-retaining cells 42 (FIG. 4) formed in a very stiff layer 34S at the image-holding surface. If the colorant 31 is water-based, then this stiff layer 34S is also hydrophilic.

Behind the stiff layer 34S, the belt has a highly compressible bulk portion 34C. If water-based colorant is in use, this compressible bulk material of the belt is hydrophobic. This correspondence can be generalized for other colorant bases, as taught e.g. by Shinkoda for oil-based colorants.

Fine channels 41 are formed through this compressible bulk material 34C, behind the cells 42—either all the way or partway through the belt. Each cell 42 is micromachined, advantageously by an excimer laser—but other processes can be substituted—to hold one to three ink-drops of about 12 pL each. The cell walls prevent the droplets from touching one another, thus suppressing colorant coalescence.

When the image is then squeezed against the printing medium, the colorant adheres to the medium as noted above. In particular, the repeatability and uniformity of this colorant transfer are both enhanced by application of pressurized air through the channels 41.

Figure 5:
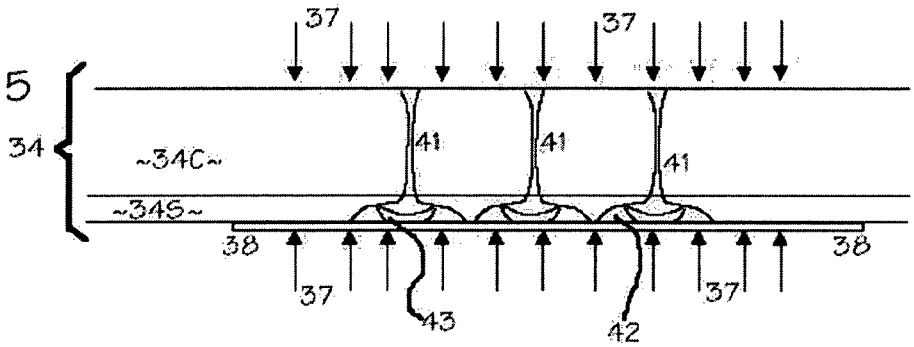
FIG. 5 is a like view but with the belt compressed by the rollers and contacting a sheet of printing medium.

The needed pressurization can be provided by an external system. Preferably, however, it is generated mechanically by the simple compression 37 (FIG. 5) of the compressible bulk material 34C within the belt, upon passage between the two squeeze rollers.

For testing purposes, before micromachining a surface was treated to define hydrophilic areas, divided by hydrophobic walls to form a 600-by-600 cell-per-inch grid. For this purpose the initial material was a standard offset plate (e.g., such as used in the Indigo systems)—but this material was also modified to increase its chemical strength and to increase the height of the walls.

Figure 7:
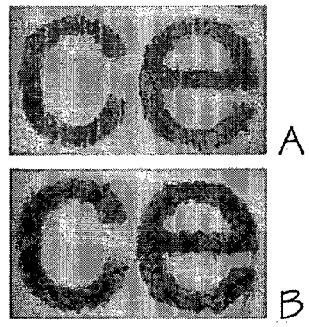
FIG. 7 is a pair of photomicrographs of printed alphabetic letters using, respectively, a belt or blanket having a preferred form of the FIG. 4 grid (view A), and a conventional belt or blanket (view B).

The difference in wettability between cells and walls plus the mechanical barrier due to the wall height keeps the colorant contained, without mixing into colorant contained in nearby cells or on the surface areas, and thereby avoiding coalescence at the grid. Tests of 10-by-10 nm printing samples showed much less coalescence and smearing in a print-out made with the 600-cell-per-inch grid (FIG. 7A) than one made instead with a conventional flat blanket (FIG. 7B).

These tests revealed further advisable development, particularly in that the transfer ratio was inadequate. Other tests, however, showed that the transfer ratio could be controlled and optimized in preparations without the cells; hence it appears that straightforward further work can refine both parameters in conjunction.

Thus the grid of cells 42 and channels 41 (FIGS. 4 and 5) helps keep latent-image dots to their correct positions and sizes, without spreading. This feature thereby leads to even better image quality than attainable with the previously described electrostatic system alone. The intrinsic affinities of the grid and the electrostatic forces also developed at the mesh advantageously supplemented each other.

Droplets of jettable substance forming the latent image—or if preferred drops or granules of the overcoat or second component used in defining the later, developed image—are advantageously (but not necessarily) attracted and held in place by electrostatic forces, but confined to specified pixel locations by the hydrophilic etc. element.

In effect, as previously mentioned, the electrostatic forces if present generate an electrostatic latent image that may be conceptualized as superimposed with (either over or under) the hydrophilically or hydrophobically generated latent image.

5. Charge Development

As mentioned above, this system can use solid or liquid ink, or toner. Electrostatic latent image formation, and the adherence provided by wetting of the deposited ink, are complementary.

Electrostatic transfer is further discussed in this section and is entirely feasible for the present invention. For reasons already explored above, however, it will be understood that high-power fixation technologies, all other things being equal, are somewhat disfavored.

Several methods can be used to develop the image. Use of solid toners such as those used for DEP printers may dictate use of the same development procedures: e.g. cascade or magnetic brushes.

For a cascade system, the toner 22 (FIG. 2) is assumed to be charged either by induction or triboelectrically by proper selection of the toner components. The electrode 23 added to the toner/developer region is advantageously at an intermediate voltage 24—representatively 300 V.

This arrangement assures different electric-field directions, respectively, for the two states available in the latent-image formation process. In other words, oppositely directed fields are established, simply depending upon whether the drum surface 14 is fresh or has received charge-compensating liquid droplets 10.

As a result, in the development stage the toner is attracted to the drum if charge is compensated—but rejected if it has not been. For optimal operation the exact intermediate voltage 24 is advantageously fine tuned.

Thus in the presence of the developer electrode, positive charged toner—while passing 26 by gravity along the dielectric skin 14—tends to be attracted by the printed (i.e. latent-image-carrying) areas of the drum, during rotation 21 of the drum about its hub 19. The toner tends to be repelled by the unprinted areas. Visible toner (or other image-actuating material) is accordingly present precisely where the latent image is.

A magnetic-brush system (not shown) uses the same principle, with the development control electrode supplied in the form of the magnetic-brush external cylinder. Liquid ink can be used by delivering it as an aerosol, in a tangential trajectory between the drum and developer control electrode—analogously to the arrangement described above.

6. Contact Development

In one simple case there is a wet latent image on the drum. Again, there can be multiple ways of using the properties of the latent image.

For example, a second component or overcoating such as a fine powder can be poured onto the wet drum. The powder sticks to the wet areas but slips off the dry portions of the surface.

This powder can just adhere to the wet spots by so-called "surface tension"—and then can even be dissolved by the fluid (or even react with it) if they have suitable chemical affinity. This represents one way to make the overcoating or "second component" discussed earlier.

An advantageous reaction between the second component or overcoating and the first "wet" component can be a reaction that simply occurs when the second component comes into contact with the first. Alternatively, or in addition, such a reaction can be made to occur—or can be enhanced—by triggering influences such as application of heat, or ultraviolet or other radiation, or a catalyst (e.g. a chemical atmosphere or yet another liquid); or by a combination of one or more of such influences.

7. Combined Charge & Contact Development

People skilled in this field will appreciate that the foregoing separate discussions—of charge development, contact development, hydrophil- or hydrophobically generated latent images, reactions, and various kinds of triggers—are all categorized somewhat arbitrarily, merely for tutorial purposes here. As a practical matter all these processes can be combined, mixed and matched somewhat at will by system designers seeking to implement the various benefits of this invention.

The contact process described above can be improved if the poured particles carry a charge of the same sign as that on the drum: particles are repelled from the drum but attracted to the positions that are wet (and oppositely charged). This arrangement enhances the efficiency of the development.

Since charge is involved, the second component too can be liquid, widening the possibilities of using this second component. As mentioned elsewhere in this document, the second component, when combined with what is forming the latent image, can react or interact in a way that enables the latent image to be made of a substance that could not have been fired using inkjet methods.

Analogously it can be a substance that could not have been applied to the drum using traditional DEP/LEP methods. Thus again the materials used in image formation can be decoupled from those used in image development, and those two processes thereby optimized independently.

That is a particularly important strength of the present invention. The second component can be either solid or liquid—even a gas.

8. Transfer

The deposited ink or pigment is transferred to the paper or other final printing medium, ordinarily by contact. The liquid in the latent-image-formation ink can be predried partially by adding a heater or fuser element to the imaging drum.

Advantageously, however, this heater need not be of such a high-power type as the fusers commonly used in laser printers and other fused-powder units. As noted earlier this invention preserves the lower-energy-consumption character of conventional inkjet printers.

9. Reset Operation

Mechanical and electrical reset must be ensured after the development and transfer operations, otherwise the information in previous pages would be left as a background to the current one and will cause print quality problems. Methods to reset the drum can vary from discharge and scrape to discharge and clean. Most of the current methods in the industry could be adapted to provide this cleaning/reset step.

10. Hardware for Implementing the Invention

The general preferred layout of apparatus for practice of this invention can vary greatly. The invention can be used in very large, floor-standing inkjet printer-plotters such as print posters or aircraft engineering drawings; and can be used in small, desk-model inkjet printers—and essentially any size unit in between.

Accordingly no single picture or diagram, or description, of overall manufactured apparatus in a case or housing should be regarded as particularly associated with the present invention. Representative apparatus is pictured and described in the many inkjet-system patents of the Hewlett-Packard Company, such as—merely by way of example—the previously mentioned U.S. Pat. No. 5,333,243 (FIGS. 26 through 32, together with associated text) and U.S. Pat. No. 6,542,258 (FIG. 44), as well as U.S. Pat. No. 5,276,970 (FIGS. 1 through 7) and U.S. Pat. No. 6,441,922 (FIGS. 12 through 18), and patents mentioned therein.

The above disclosure is intended as merely exemplary, and not to limit the scope of the invention—which is to be determined by reference to the appended claims.

What is claimed is:

1. A printing device comprising:

a transfer surface on which an electrostatic charge is to be applied;

an inkjet-printing mechanism to eject a liquid to form a latent image on the transfer surface after the electrostatic charge has been applied to the transfer surface;

a voltage supply operatively coupled to the transfer surface to maintain the transfer surface at a first voltage;

an image-actuation mechanism to associate another, separate substance with the latent image on the transfer surface to actuate the image, the image-actuation mechanism being a different mechanism than the inkjet-printing mechanism, wherein the inkjet-printing mechanism is to be maintained at a second voltage different than the first voltage, such that a voltage difference is to exist between the transfer surface and the inkjet-printing mechanism.

2. The printing device of claim 1, wherein the inkjet-printing mechanism is to be maintained at an electrical ground, such that the second voltage is zero volts, and the voltage difference between the transfer surface and the inkjet-printing mechanism is equal to the first voltage.

3. The printing device of claim 1, wherein the voltage supply is a first voltage supply, and the printing device farther comprises a second voltage supply different than the first voltage supply and operatively coupled to the image-actuation mechanism to maintain the image-actuation mechanism at a third voltage greater than the second voltage and less than the first voltage.

4. The printing device of claim 3, wherein the third voltage is equal to half of the first voltage.

5. The printing device of claim 3, wherein the third voltage is equal to half of a voltage difference between the first voltage and the second voltage.

6. The printing device of claim 1, wherein the other, separate substance is a liquid ink.

7. The printing device of claim 1, wherein the other, separate substance is a solid ink.

8. The printing device of claim 1, wherein the other, separate substance is toner.

9. The printing device of claim 1, wherein the other, separate substance comprises plural such substances of different colors to cooperative to form a color image.

10. A printing device comprising:

a transfer surface on which an electrostatic charge is to be applied;

inkjet-printing means for ejecting a liquid to form a latent image on the transfer surface after the electrostatic charge has been applied to the transfer surface;

voltage supply means for maintaining the transfer surface at a first voltage;

image-actuation means for associating another, separate substance with the latent image on the transfer surface to actuate the image, the image-actuation means being a different mechanism than the inkjet-printing means, wherein the inkjet-printing means is maintained at a second voltage different than the first voltage, such that a voltage difference exists between the transfer surface and the inkjet-printing means.

11. The printing device of claim 10, wherein the inkjet-printing means is maintained at an electrical ground, such that the second voltage is zero volts, and the voltage difference between the transfer surface and the inkjet-printing means is equal to the first voltage.

12. The printing device of claim 10, wherein the voltage supply means is a first voltage supply means, and the printing device farther comprises a second voltage supply means different than the first voltage supply means for maintain the image-actuation means at a third voltage greater than the second voltage and less than the first voltage.

13. The printing device of claim 12, wherein the third voltage is equal to half of the first voltage.

14. The printing device of claim 12, wherein the third voltage is equal to half of a voltage difference between the first voltage and the second voltage.

15. The printing device of claim 10, wherein the other, separate substance is a liquid ink.

16. The printing device of claim 10, wherein the other, separate substance is a solid ink.

17. The printing device of claim 10, wherein the other, separate substance is toner.

18. The printing device of claim 10, wherein the other, separate substance comprises plural such substances of different colors to cooperative to form a color image.

19. A method comprising:

applying an electrostatic charge to a transfer surface;

after the electrostatic charge has been applied to the transfer surface, ejecting a liquid by an inkjet-printing mechanism to form a latent image on the transfer surface;

maintaining the transfer surface at a first voltage via a voltage supply operatively coupled to the transfer surface;

associating another, separate substance with the latent image on the transfer surface to actuate the image, using an image-actuation mechanism that is different than the inkjet-printing mechanism;

maintaining the inkjet-printing mechanism at a second voltage different than the first voltage, such that a voltage difference exists between the transfer surface and the inkjet-printing mechanism.

20. The method of claim 19, further comprising maintaining the inkjet-printing mechanism at an electrical ground, such that the second voltage is zero volts, and the voltage difference between the transfer surface and the inkjet-printing mechanism is equal to the first voltage.

21. The method of claim 19, wherein the voltage supply is a first voltage supply, and the method further comprising maintaining the image-actuation mechanism at a third voltage greater than the second voltage and less than the first voltage via a second voltage supply different than the first voltage supply and operatively coupled to the image-actuation mechanism.

22. The method of claim 21, wherein the third voltage is equal to half of the first voltage.

23. The method of claim 21, wherein the third voltage is equal to half of a voltage difference between the first voltage and the second voltage.

24. The method of claim 19, wherein the other, separate substance is a liquid ink.

25. The method of claim 19, wherein the other, separate substance is a solid ink.

26. The method of claim 19, wherein the other, separate substance is toner.

27. The method of claim 19, wherein the other, separate substance comprises plural such substances of different colors to cooperative to form a color image.

* * * * *

UNITED STATES PATENT AND TRADEMARK OFFICE

CERTIFICATE OF CORRECTION

PATENT NO. : 7,677,716 B2
APPLICATION NO. : 11/043772
DATED : March 16, 2010
INVENTOR(S) : Ramon Vega et al.

It is certified that error appears in the above-identified patent and that said Letters Patent is hereby corrected as shown below:

In column 15, line 60, in Claim 3, delete "farther" and insert -- further --, therefor.

In column 16, line 36, in Claim 12, delete "farther" and insert -- further --, therefor.

Signed and Sealed this

Twenty-second Day of June, 2010

David J. Kappos

David J. Kappos
*Director of the United States Patent and Trademark Office*